United States Patent [19]

Daviss

[11] Patent Number: 4,491,220

[45] Date of Patent: Jan. 1, 1985

[54] CONTAINER FOR HOLDING POPCORN AND A DRINK CUP

[76] Inventor: Gilbert P. Daviss, 825 McArthur Blvd., Warner Robins, Ga. 31093

[21] Appl. No.: 585,425

[22] Filed: Mar. 2, 1984

[51] Int. Cl.[3] ..... B65D 3/28; B65D 23/12

[52] U.S. Cl. ..... 206/217; 206/218; 229/1.5 H; 220/23.4; 220/85 H; 215/100 R

[58] Field of Search ..... 206/217, 218, 44.11; 220/23.4, 23.83, 85 H; 215/100 R; 229/1.5 H, 1.5 C; 294/31.2, 33; 248/312.1

[56] References Cited

U.S. PATENT DOCUMENTS

| | | | |
|---|---|---|---|
| 2,387,982 | 10/1945 | DeMuth | 248/312.1 |
| 2,794,545 | 6/1957 | Olson | 229/1.5 B |
| 3,051,365 | 8/1962 | Sayford, Jr. | 229/1.5 H |
| 3,104,788 | 9/1963 | Wood | 229/1.5 H |
| 3,222,023 | 12/1965 | Schweitzer | 215/100 R |
| 3,288,344 | 11/1966 | Wooller et al. | 206/217 |
| 3,323,706 | 6/1967 | Gereke | 206/217 |
| 3,610,409 | 10/1971 | Graf | 220/23.4 |
| 3,640,380 | 2/1972 | Huffman | 229/28 R |
| 4,183,444 | 1/1980 | English et al. | 220/85 R |

FOREIGN PATENT DOCUMENTS

| | | | |
|---|---|---|---|
| 683505 | 3/1964 | Canada | 206/217 |
| 558159 | 1/1975 | Switzerland | 229/1.5 H |
| 972788 | 10/1964 | United Kingdom | 206/217 |
| 2023407 | 1/1980 | United Kingdom | 206/217 |

*Primary Examiner*—William T. Dixson, Jr.
*Assistant Examiner*—Brenda J. Ehrhardt
*Attorney, Agent, or Firm*—Thomas & Kennedy

[57] ABSTRACT

A container for holding popcorn and a drink cup has a box 10, 30 with a band 20, 35 mounted to one box wall beneath a slot 18, 32, 33. The box may be filled with popcorn and a drink cup 25, 37 held by the band to the box with a cup lip 26, 38 projecting into the slot.

12 Claims, 5 Drawing Figures

CONTAINER FOR HOLDING POPCORN AND A DRINK CUP

TECHNICAL FIELD

This invention relates generally to containers, and particularly to popcorn boxes.

BACKGROUND OF THE INVENTION

Popcorn boxes are conventionally made from cardboard blanks that are formed with folds whereby the four vertical walls of a box can be folded flat and the box can be stored in a flat configuration. When the boxes are to be used the top box on a stack of boxes is opened by separating the oposite walls of the box, whereupon the box floor, which is formed with interlocking tabs, is snapped into a position that closes the lower end of the box and the box then can be filled with popcorn. The box top can be left unfolded as vertical extensions of the box sides or it can be folded to a closed position to hold the popcorn in the box.

Popcorn is sold at concession stands such as those in motion picture theatres. At these concession stands cold drinks such as various colas are also typically sold as companion sales. The cold drinks are sold in plastic cups which usually are of a frustro-conical shape. It often occurs that an individual customer will purchase one or more boxes of popcorn as well as one or more drinks all in a single transaction. When this happens the customer must, of course, carry the boxes of popcorn and drinks into the theatre for consumption. When more than one box of popcorn and one drink is purchased it is difficult to carry them with manual facility. It thus happens that the customer will have to project his fingers into the open tops of several boxes of popcorn and perhaps attempt to hold two drink cups together between his arm and body. This obviously is a cumbersome technique which enhances the risk of spillage. The present invention is directed at providing a container which tends to overcome these problems and which facilitates the portability of popcorn and drinks.

SUMMARY OF THE INVENTION

Briefly described, the present invention comprises a container or box for holding popcorn and similar substances together with a drink cup. The box includes four upstanding walls and a floor with one upstanding wall being formed with a slot extending parallel with the floor. An annular band is secured to the slotted wall of the box at a level below the slot with the annular band being oriented approximately prallel to the length of the slot and approximately parallel with the floor. The band is of a size adapted to extend about and hold a drink cup beneath the cup lip and with the cup positioned adjacent to the wall of the box and with the cup lip projecting into the slot. This tends to attach the relatively light box filled with popcorn to the heavier cup filled with the liquid drink and ice, whereby a person can grasp and carry the cup and the box of popcorn will safely travel with the cup.

The box is foldable to a flat collapsed configuration so that it can be stored and stacked in a flat configuration and later unfolded to hold a supply of popcorn. The band is formed with two folds whereby it can be positioned flat upon the box during storage and during those instances when the box is used without attaching a drink to the box. In order to attach the box to the cup, the band is opened by partially pulling the band away from the box and a cup is moved downwardly through the band until the band fits snugly about the cup and the protruding upper rim of the the cup projects into the slot of the adjacent side wall of the box.

Thus, it is an object of this invention to provide a popcorn box which can be conveniently and securely attached to a conventional paper or plastic drinking cup.

It is another object of this invention to provide a box for containing popcorn and the like and which includes a means for mounting the box to a drinking cup whereby a person can carry the drinking up and the box will travel with the drinking cup, and which permits the drink and box to be easily separated.

Other objects, features and advantages will become apparent upon reading the following specification when taken in conjuncton with the accompanying drawings.

DETAILED DESCRIPTION

Figure 1:
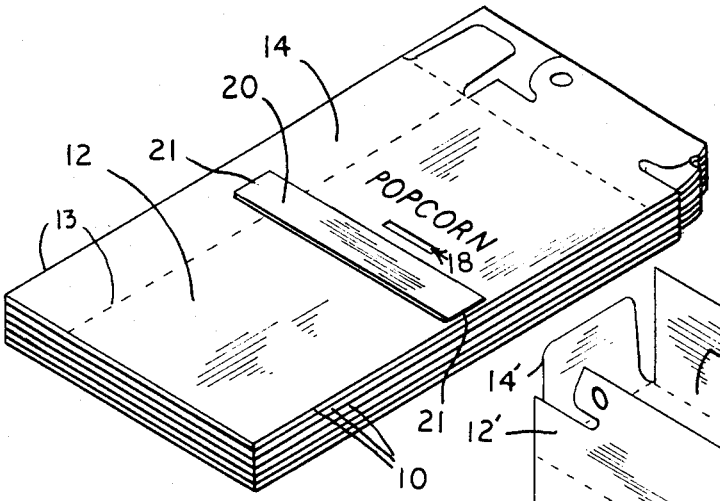
FIG. 1 is a perspective view of a stack of containers embodying principles of the present invention.

Referring now in more detail to the drawings, in which like numerals indicate like parts throughout the several views, FIG. 1 illustrates a plurality of containers 10 stacked in a flat configuration, one atop the other. Each container is seen in general to be in the form of a conventional popcorn box which has a front wall or side 12, two side walls 14 conjoined with the front wall 12, and a rear wall or side 16 conjoined with the two side walls. These walls meet at four corners 13 which are provided by folds in a cardboard blank from which the box is formed. The box also has a folding floor 15 of conventional interlocking tab construction and a foldable top which is formed by tabs 12', 14' and 16'. The container so far described is thus of typical popcorn box construction.

Figure 3:
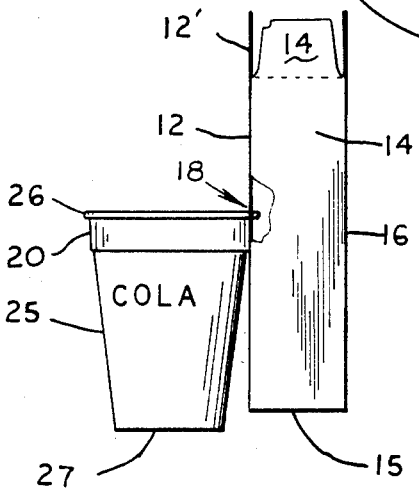
FIG. 3 is a side elevational view of the container shown in FIG. 2 with a drink cup mounted thereto.

A slot 18 is formed in the front wall 12 which extends parallel with the floor 15. This slot is of the size sufficient to accomodate the lip of a cup, with or without a cover placed thereupon and yet insufficient to permit the passage of popcorn therethrough. A flexible, annular band 20 is attached to the front wall 12 by adhesive (not shown) at a level just beneath the slot 18. The band has two folds 21 which permit the band to collapse to a flat configuration adjacent the front wall 12. The band is of a diameter when expanded from its compacted, folded configuration as shown in FIG. 1, to accomodate and snuggly hold a upper portion of a conical cup 25, as shown in FIG. 3, just beneath the upper rim or lip 26 of the cup. In the configuration shown in the drawing, the slot and band are positioned at a height upon wall 12 such that the bottom rim 27 of the cup 25 is slightly below the floor 15 of the box 10 so that the cup may be set flat atop a supporting surface.

Figure 2:
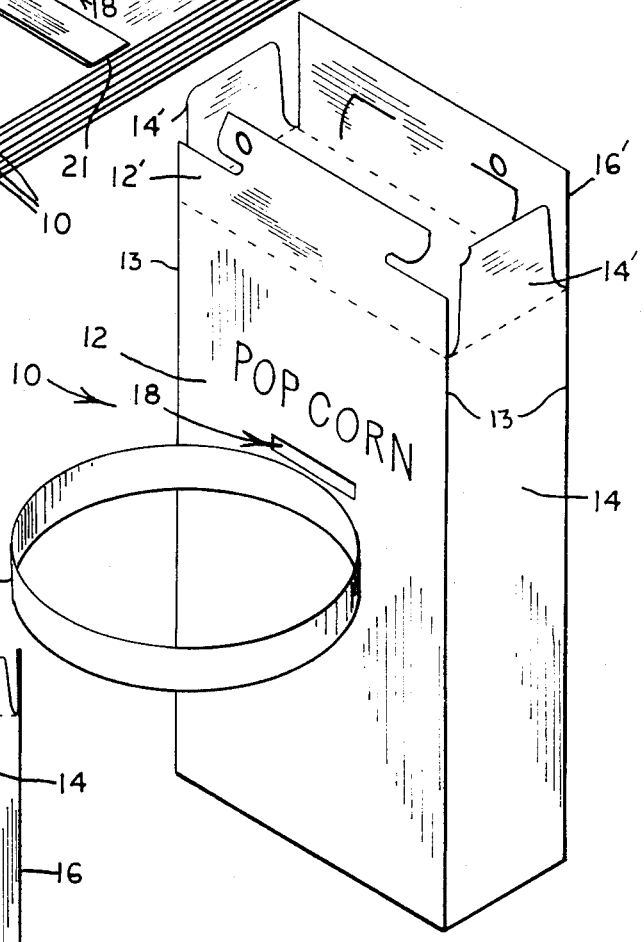
FIG. 2 is a perspective view of one container shown in the stack of FIG. 1 in an open configuration.
Figure 5:
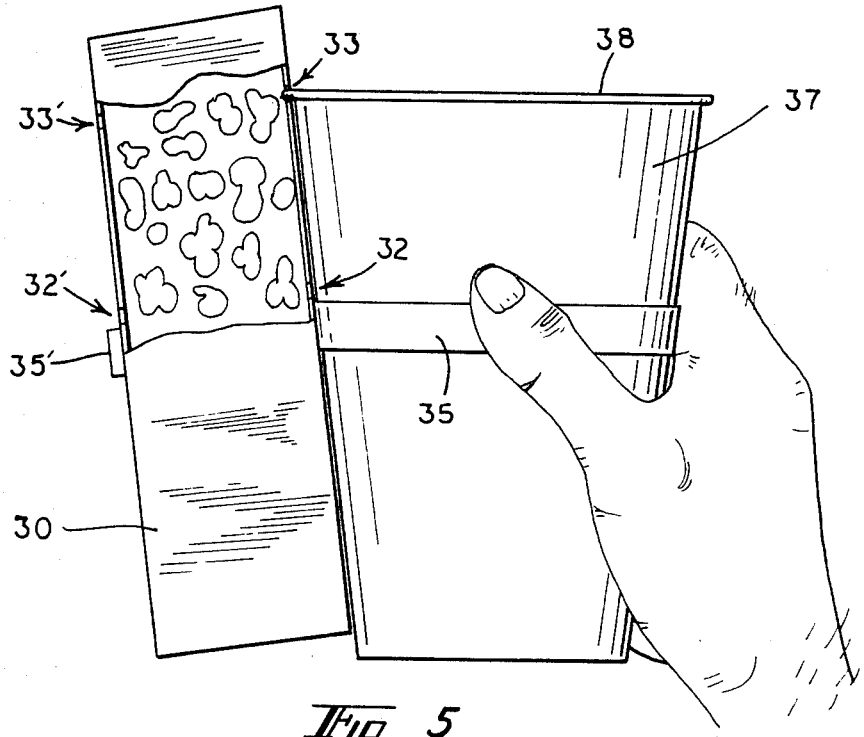
FIG. 5 is a side elevational view, partly in cross section, of a container embodying principles of the invention in another form with a drink cup mounted thereto.
Figure 4:
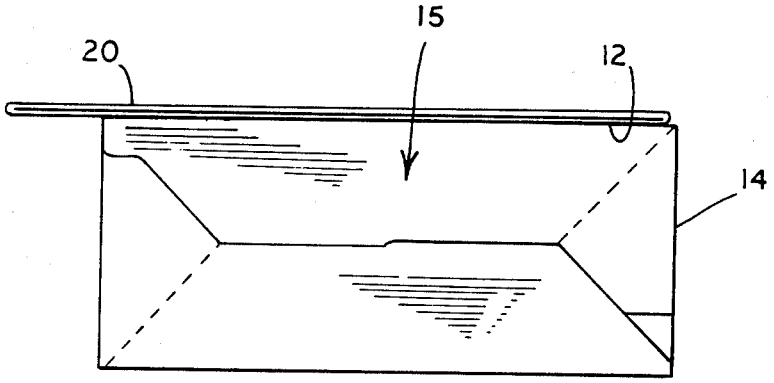
FIG. 4 is a bottom view of the container shown in FIG. 2.

As shown in FIG. 1 the containers 10 can be stacked in a flat configuration one upon the other with both the box and annular bands folded flat. When it is desired to use one of the containers the box 10 is opened, thereby closing the box floor 15, whereupon the box can be filled with a supply of popcorn and the box top can remain in an open configuration or can be closed. Should the customer not purchase a drink the band 20 is simply left in its folded configuration. Should the customer also purchase a drink the band is spread into a generally annular configuration as shown in FIG. 2 and a cup filled as with an iced drink and then passed downwardly through the band with the narrower lower end of the frustum-shaped cup moving through the larger band until the larger upper portion of the cup fills the band and until the protruding cup lip projects into slot 18. So held the cup is prevented from moving up and down or from side to side. Thus, the band functions as a cup holding means mounted to the box. The box and cup can then be carried with one hand by the customer away from the concession stand for consumption, usually with the customer gripping the heavier and more sturdy cup rather than the box. While being carried the box usually will gravitate against the cup, as illustrated in FIG. 5. If the container is set upon a flat surface the drink cup and box will typically remain together rather than separate, as shown in FIG. 5.

If desired one or more additional slots can be provided in the same box wall to accomodate larger diameter cups. In addition, another slot can be formed in the box rear wall and another annular band secured thereto whereby two drink cups can be carried and supported upon one popcorn box. Such an alternative configuration is shown in FIG. 5 where a popcorn box 30 is seen to have two lower slots 32 and 32' formed in opposite box walls, and two upper slots 33 and 33' formed above them, respectively. Similarly, two annular bands 35 and 35' are mounted to the box below the lower slots. A relatively large drink cup 37 is seen to be mounted within the band 35 with its lip 38 seated in slot 33. Here the container is shown being carried with the cup held vertically to prevent spillage and with a box full of popcorn held thereto along a slight incline. In this figure the top of the box is closed. Where two cups are secured to one box the box itself normally would be oriented vertically so that each cup is only slightly inclined to avoid spillage where lids are not provided.

It thus is seen that a container is provided by which a supply of popcorn and a liquid drink can be carried together in one hand. The container can be stored in a compacted configuration yet readily opened for use. If a drink cup is not purchased in conjunction with the purchase of popcorn the annular band 20 can be left in its folded configuration. However, if a drink is also purchased the drink cup can be readily moved downwardly into the band and slot in one motion and virtually fall into place. Once a drink cup is placed within the slot the band it will be held securely to the box where it will not be readily dislodged. Versatility is provided so that more than one cup and more than one size of cup may be mounted to the same box.

When the cup and box are to be separated, the band can be torn with the fingers to open the band, or the surface of the box immediately above the slot can be pushed inwardly to cause the slot to release the protruding lip of the cup, whereupon the cup can be lifted up out of the band.

It should be understood that the just described embodiment merely illustrates principles of the invention in selected, preferred forms. Many modifications, additions and deletions may, of course, be made thereto without departure from the spirit and scope of the invention as set forth in the following claims.

I claim:

1. A container for holding popcorn and a drink cup comprising a box in which a supply of popcorn can be contained, said box having four walls and a floor with one of said walls being formed with a slot extending generally parallel with said floor, and an annular band secured to said one wall below said slot generally parallel with said floor of a size adapted to hold a drink cup beneath the cup lip with the cup lip projecting into said slot.

2. The container of claim 1 wherein said slot is located at a height above said floor for holding a drink cup with the cup bottom below level with said box floor.

3. The container of claim 1 wherein said band is flexible and is formed with folds whereby it can be stored flat against said box.

4. The container of claim 3 wherein said box is formed with a plurality of folds and is collapsible whereby it can be stored in a flat configuration.

5. In combination, a container for holding popcorn and a drink cup, said container comprising a box in which a supply of popcorn can be contained, said box having four upstanding walls and a floor with one of said walls being formed with a slot, cup holding means mounted to said box one wall between said slot and said floor, and a cup having an upper outwardly protruding lip in which a drink can be contained held in said cup holding means beside said box one wall with the cup lip located above said band and projecting into said slot.

6. The container of claim 5 wherein said cup holding means comprises an annular band, and wherein said slot and said band are oriented generally parallel with said box floor.

7. The container of claim 5 wherein said cup has a bottom below said box floor.

8. The container of claim 6 wherein said band is flexible and is formed with folds whereby it can be stored flush against said box one wall.

9. The container of claim 8 wherein said box is collapsibly formed with a plurality of folds whereby it can be stored in a flat configuration.

10. A container that can be stored and stacked in a flat configuration and unfolded to hold a supply of popcorn and a drink cup, and with said container comprising a flexible box formed with four parallel folds whereby it may be folded in a flat configuration for storage and unfolded into a box shaped configuration to hold a supply of popcorn and with said folds defining corners of conjoined sides of said box, a slot formed in one of said box sides, and cup holding means mounted to said box one side adjacent said slot in which a drink cup can be held with a cup lip extending into said slot, and with said cup holding means being collapsible whereby it can be positioned flat upon said box one side for storage.

11. The container of claim 10 wherein said slot extends generally normally to said box folds.

12. The container of claim 11 wherein said cup holding means comprises an annular band mounted to said box one side generally parallel said slot.

* * * * *